United States Patent [19]

Molitor et al.

[11] Patent Number: 4,762,322

[45] Date of Patent: Aug. 9, 1988

[54] GOLF CLUB

[75] Inventors: Robert P. Molitor, Niles, Mich.; Bernard McDermott, Akron, Ohio; Dominick J. Swistro, Holyoke; Steven J. Mahaffey, Hampden, both of Mass.

[73] Assignee: Spalding & Evenflo Companies, Inc., Chicopee, Mass.

[21] Appl. No.: 762,573

[22] Filed: Aug. 5, 1985

[51] Int. Cl.[4] ..... A63B 53/04

[52] U.S. Cl. ..... 273/77 A; 273/167 H; 273/169; 273/80 A; 273/DIG. 8

[58] Field of Search ..... 273/167 H, 167 F, 169, 273/171, DIG. 8, 80 A, 77 R, 77 A, 78, 170, 172, 173, 174, 175

[56] References Cited

U.S. PATENT DOCUMENTS

| | | | |
|---|---|---|---|
| 1,516,786 | 11/1924 | Prentiss . | |
| 1,594,801 | 8/1926 | Stackpole . | |
| 1,665,523 | 4/1928 | Boyce . | |
| 2,231,847 | 2/1941 | Dickson et al. | 273/80.7 |
| 2,447,967 | 8/1948 | Stone | 273/78 |
| 3,059,926 | 10/1962 | Johnstone | 273/77 |
| 3,212,783 | 10/1965 | Bradley et al. | 273/171 |
| 3,416,797 | 12/1968 | Pfau | 273/77 |
| 3,455,558 | 7/1969 | Onions | 273/169 |
| 3,473,370 | 10/1969 | Marciniak | 73/65 |
| 3,539,184 | 11/1970 | Koorland | 273/77 |
| 3,655,188 | 4/1972 | Solheim | 273/77 |
| 3,698,239 | 10/1972 | Everett | 73/65 |
| 3,722,887 | 3/1973 | Cochran et al. | 273/77 |
| 3,751,035 | 8/1973 | Lockwood | 273/77 |
| 3,843,122 | 10/1974 | Florian | 273/169 X |
| 3,845,955 | 11/1974 | Solheim | 273/77 |
| 3,871,649 | 3/1975 | Kilshaw | 273/77 |
| 3,897,065 | 7/1975 | Solheim | 273/167 |
| 3,937,474 | 2/1976 | Jepson et al. | 273/173 |
| 3,963,236 | 6/1976 | Mann | 273/77 |
| 3,995,865 | 12/1976 | Cochran et al. | 273/167 |
| 4,021,047 | 5/1977 | Mader | 273/167 |
| 4,027,885 | 6/1977 | Rogers | 273/169 |
| 4,070,022 | 1/1978 | Braly | 273/77 |
| 4,076,254 | 2/1978 | Nygren | 273/171 X |
| 4,123,055 | 10/1978 | Brill | 273/77 |
| 4,128,242 | 12/1978 | Elkins | 273/177 |
| 4,147,349 | 4/1979 | Jeghers | 273/77 |
| 4,200,286 | 4/1980 | Bennett | 273/77 |
| 4,247,105 | 1/1981 | Jeghers | 273/77 |
| 4,261,566 | 4/1981 | MacDougall | 273/77 |
| 4,280,700 | 7/1981 | Plagenhoef | 273/77 |
| 4,319,752 | 3/1982 | Thompson | 273/171 |
| 4,322,083 | 3/1982 | Imai | 273/167 |
| 4,326,716 | 4/1982 | La Coste | 273/DIG. 8 |
| 4,367,878 | 1/1983 | Schmidt | 273/175 |
| 4,415,156 | 11/1983 | Jorgensen | 273/77 |
| 4,422,638 | 12/1983 | Tucker | 273/78 |
| 4,432,549 | 2/1984 | Zebelean | 273/167 |
| 4,438,931 | 3/1984 | Momtomiya | 273/167 |
| 4,449,707 | 5/1984 | Hayashi et al. | 273/171 |
| 4,451,041 | 5/1984 | Hayashi et al. | 273/167 |
| 4,451,042 | 5/1984 | Hayashi et al. | 273/171 |
| 4,471,961 | 9/1984 | Masghati et al. | 273/175 |
| 4,489,945 | 12/1984 | Kobayashi | 273/167 |
| 4,498,672 | 2/1985 | Bulla | 273/169 |
| 4,498,673 | 2/1985 | Swanson | 273/172 |
| 4,508,349 | 4/1985 | Gebauer | 273/175 |
| 4,508,350 | 4/1985 | Duclos | 273/183 |
| 4,512,577 | 4/1985 | Solheim | 273/77 |
| 4,534,558 | 8/1985 | Yoneyama | 273/78 |
| 4,614,627 | 9/1986 | Curtis et al. | 273/167 H |
| 4,650,191 | 3/1987 | Mills | 273/80 A |

FOREIGN PATENT DOCUMENTS

| | | | |
|---|---|---|---|
| 211781 | 12/1957 | Australia | 273/167 H |
| 488469 | 7/1938 | United Kingdom | 273/167 H |

*Primary Examiner*—George J. Marlo

*Attorney, Agent, or Firm*—Lahive & Cockfield

[57] ABSTRACT

Disclosed is a unified set of golf clubs, from wood clubs through wedge clubs, in which loft and lie angles, face progression, and club lengths are coordinated and correlated. The center of gravity of each club is lower, further back and more centered on the club face than is usual. In addition, each golf club of the set features a sole width of at least 1.25 inches. The center of gravity of each club head is located no more than 0.7 inch above the sole and at least 0.5 inch from the centerline of the club shaft.

The club heads of this invention may be fabricated as a hollow metal shell. Alternatively, the club heads may be formed of a low density, high strength material such as reaction injection molded polyurethane. In such an embodiment weighted inserts are molded into and encapsulated within the polyurethane.

4 Claims, 7 Drawing Sheets

GOLF CLUB

FIELD OF THE INVENTION

This invention relates in general to golf clubs and more particularly to a construction of golf clubs and golf club sets that provide for better playing characteristics. The invention also relates to a set of clubs, ranging from driver through high lofted irons, of common construction, features, and head appearance, and having a predetermined sequence of changes of club face loft angle, lie, legnth, and club face offset.

BACKGROUND OF THE INVENTION

A tenet of golf technique is that the swing should be as uniform as possible with all clubs. However, conventional golf club construction has tended to promote dissimilar swings with different clubs. Conventional golf club sets comprise woods and irons with the woods typically differing significantly in construction, appearance, and playing characteristics from the irons. Woods have a much wider sole (from front to back) than irons, and are usually constructed of wood or laminated wood integrated with a metal sole plate and often an insert at the face to provide a hitting surface. Typically, weights are included in the wood construction to alter the balance of the club. Irons, on the other hand, are formed of metal and have a relatively narrow sole, typically no greater than about 1 inch, even for high loft clubs such as the sand club and pitching wedge. The club head of a wood typically has a center of gravity which is low and displaced rearwardly whereas the club head of the irons has a higher center of gravity close to the club face.

These and other differences in club construction mean that the club set is not a continuous or integrated set with regular progressions or characteristics from the driver through the 9 iron, pitching wedge, and sand club. This discontinuity of design requires the two types of clubs to be played differently so that the player must alter his swing when changing from a wood to an iron or vice versa.

Additionally, the construction characteristics of wood club heads place constraints on freedom of design from a dynamic point of view. Thus, the wood club heads are restricted in strength and weight distribution because of the shortcomings of the material. Additionally, precision in shape and loft is difficult to achieve with conventional wood material. Strength considerations also affect the face progression in the woods.

It is an object of this invention to provide a club head design which improves the playing and hitting characteristics of both woods and irons. Another object is to provide a number of clubs which together constitute a continuous set made up of clubs which vary in a substantially regular manner from the driver through the wedges and which have common design features. Another object is to provide a golf club set comprising individual clubs each of which has a wide sole normally present only in woods. Yet another object is to provide a golf club construction which leads to improved playability characteristics in that the clubs are easier to hit than conventional clubs, and balls hit with the clubs fly higher and travel straighter than balls hit with conventional clubs.

These and other objects of the invention will be apparent from the description, drawing, and claims which follow.

SUMMARY OF THE INVENTION

Broadly, the present invention provides a unified set of clubs progressing from the driver to the wedge in which loft and lie angles, face progression, and club lengths are coordinated and correlated without any over-lap of loft or lie angles or duplication of the playing characteristics of the club. Additionally, each club has common design features including a center of gravity in the club head which is lower, further back, and more centered on the club face than is usual, and including in all clubs a very wide sole which normally is characteristic only of woods.

Clubs constructed in accordance with the invention are generally easier to hit than conventional clubs. Tests have shown that balls hit with clubs embodying the invention travel straighter and higher than balls hit with similar force with conventional clubs.

In one embodiment of the invention, the heads of the clubs are fabricated as a hollow metal shell having a weight distribution to achieve balance and a center of gravity which is lower than that of conventional clubs and located further back from the club face than is usual. Irons made with this construction preferably have a male hosel. In a second embodiment, the clubs are formed of low density, high strength material such as reaction injection molded (RIM) polyurethane. These clubs have an appropriate hosel construction and use insert weights molded into and encapsulated by the polyurethane material to achieve appropriate balance, lower center of gravity, and a better match between the resiliency of the club and ball, thereby achieving better hitting characteristics.

In clubs constructed in accordance with the invention, the lower numbered clubs are characterized by a smaller club head than conventional woods while the higher numbered clubs are characterized by a wider sole than conventional irons. All clubs in the set are characterized by a continuity in face profile and a more uniform, predetermined progression of lofts, lies, face and leading edge progression, club length, and other characteristics which result in a set of clubs that can be played without experiencing a significant discontinuity between the mechanics of play of lower and higher numbered clubs. Clubs of this invention are characterized by a hitting performance which is more forgiving of mishits, permits straighter hitting, and higher hits, even when compared with loft angles which are the same.

As a material for club heads, reaction injection molded polyurethane approaches the density of wood, (0.7 to 0.9 g/cc.), but readily allows changes in shape and weight distribution. Because the club is molded there is a much greater reproducibility of club face angle as well as other shape factors in the club head. The exceptional strength of this material allows the design of a narrower, slimmer profile hosel resulting in the removal of weight which can be added to the body of the head lowering the center of gravity. This also allows for more flexibility in design by allowing the positioning of the hosel closer to the front of the face such that the distance between the vertical extension of the center line of the hosel and the center line of the hitting surface of the club is diminished. The change in shape and smaller size of the club head for woods, together with selective weighting, provides for a lower center of gravity and also a center of gravity that is more removed from the heel of club, both features providing for improved hitting characteristics. The use of reaction injection molded polyurethane allows weights to be inserted in the molding process, which weights are encapsulated within and bonded to the material of the club head, thereby providing a completely integrated club head construction. Inserts at the club face need not be used as the polymer material itself can provide excellent resiliency as a hitting surface.

The use of RIM polyurethane in the construction of clubs of the irons type also provides improved characteristics. The use of RIM polyurethane or other material of low density and high strength to weight ratio in the construction of clubs of the iron type permit the use of a wider sole and a lower center of gravity. This in turn allows more preferential weight distribution toe to heel, as well as from the club face of the iron towards the back of the club, thereby providing better hitting characteristics, particularly on off-center hits. The use of RIM polyurethane at the club face also provides better resiliency matching with the ball.

In both the hollow metal and RIM polyurethane embodiments, the use of a wider sole dimension in the irons together with the smaller sole dimension in the woods, and the continuous progression of loft in the club faces and other characteristics, provides for a more or less continuous smooth change from club to club so that the entire club set is integrated and does not require a discontinuity in swing approach between woods and irons.

BRIEF DESCRIPTION OF THE DRAWING

Like reference characters in the respective drawn figures indicate corresponding parts.

DESCRIPTION

Figure 1:
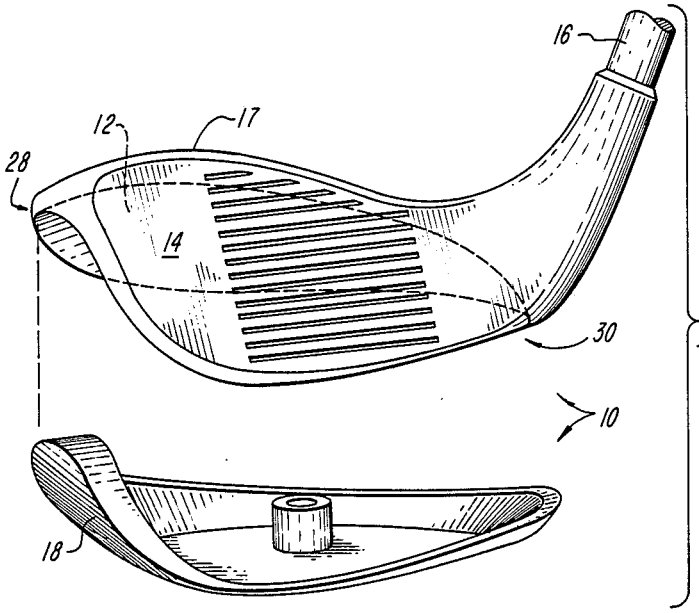
FIG. 1 is a schematic exploded view of a golf club head showing a preferred construction in accordance with the invention.

As used herein the following terms have the following meanings:

BOUNCE—the sole angle of an iron when the trailing (back) edge of the sole is below the leading (front) edge of the sole in the playing (hitting) position.

CENTER OF GRAVITY—center of mass and/or the location where all balance points intersect.

CROWN—the (usually) curved top of a club head.

FACE—the hitting surface of a wood or iron club.

FACE RADIUS—a convex curve on the face from heel to toe.

IRON—a club, not necessarily made of iron or other metal, having a loft angle of at least 22°.

LEADING EDGE PROGRESSION—distance from the shaft center line to the front leading edge of the club face on its center line.

FEMALE HOSEL—the type of head to shaft assembly where the shaft fits inside the hosel.

GEAR EFFECT—the effect caused when off-center hits cause a rotational movement of both the ball (in one direction) and the club head (in the opposite direction) and the club face is pushed across the back of the ball like enmeshed gear wheels.

HEAD—one of the three major components of a golf club whose extremities are called toe, sole, heel, and crown.

HEEL—that portion of the head where the sole and the hosel meet.

HOSEL—that portion of a wood or iron head designed to interfit with the shaft.

INVESTMENT CASING—a method of producing metal golf clubs and sole plates. A wax (pattern) is cast from a mold, then dipped into a ceramic mixture which hardens. The ceramic "shell" (with the wax head inside) is heated; the wax melts out (lost wax) and molten metal (stainless steel, etc.) is poured into the ceramic shell (invested) and allowed to harden. The shell is broken leaving an exact duplicate of the master model.

LEADING EDGE—the lower edge of the face of the club head that separates the face from the sole of the club. Often a curve, that is, a curved surface connecting the face and the sole.

LIE—the angle formed by the center line of the shaft and the horizontal when the club is rested on its sole in the designated playing position.

LOFT—the angle formed between the central axis of the shaft and hosel (vertical) and the face.

MALE HOSEL—the type of head to shaft assembly in which the shaft fits over the hosel.

SOLE—the bottom surface of a golf club that rests on the ground when the club is held in the playing (hitting) position. The sole may be cambered, flat, or slightly concave from front to back. As used herein, the sole is defined as the bottom surface of the club, and tangents to the surface, extending from front to back, intersect at angles greater than about 170°.

SOLE CAMBER—a curve on a sole from front to back. The sole camber is a slightly convex radius curve, but the sole may also be flat or slightly concave.

SOLE PLATE—a plate attached or routed into the sole (bottom) of a club head to prevent wear and to add weight.

SOLE WIDTH—the greatest distance from the front edge to the rear edge of the sole. The front edge is defined as the intersection of the sole curve (including flat soles or slightly concave soles) and the leading edge curve which connects the sole to the face. The back edge is defined as the intersection of the sole curve and the back curve which connects the sole to the rear surface of the club head.

TOE—the part of a club head that is farthest away from the shaft hosel.

WOOD—a club, not necessarily made of wood, having a loft angle less than 22°.

FIG. 1 of the drawing shows a preferred type of construction for clubs embodying the invention. As illustrated, the head 10 is formed of a body part 12 defining the face 14 and a rear surface of the club head as well as a hosel 16. A separately fabricated sole piece 18 interfits as shown with the body part 12. Both the body part 12 and the sole piece 18 are preferably formed of metal, usually a high strength steel such as 17–4 stainless, and are fabricated by the well-known investment casting technique. The two pieces may be assembled by welding to produce a hollow metal head.

The body part 12 and sole piece 18 are shaped to reduce the weight in the heel 30 and increase weight in the toe 28 allowing the center of gravity to be moved toward the center of the club face. The hosel 16 is male, of small diameter, and thin walled as compared to conventional golf clubs. The high point of the crown 17 of the club head 10 is displaced toward the toe 28 from the hosel 16.

Figure 3:
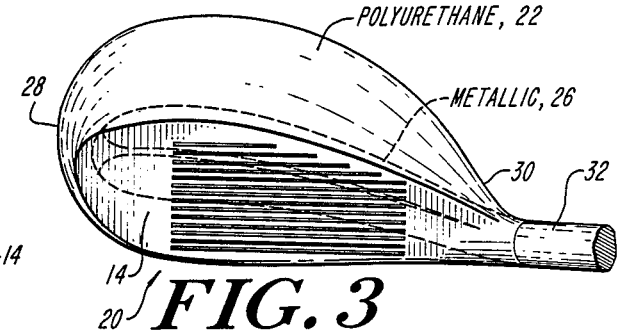
FIG. 3 is a schematic, top view of a seven iron embodying the invention showing an encapsulated metallic insert weight in phantom.
Figure 4:
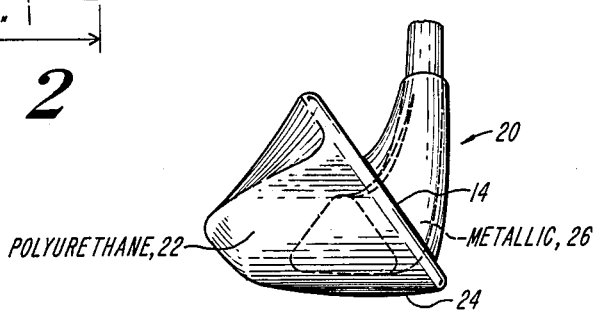
FIG. 4 is a schematic, front (toe-on) view of the club of FIG. 3.
Figure 6B:
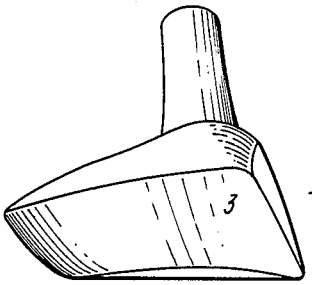
FIGS. 6A–6L are toe-on views of the clubs of FIGS. 5A–5L.
Figure 6A:
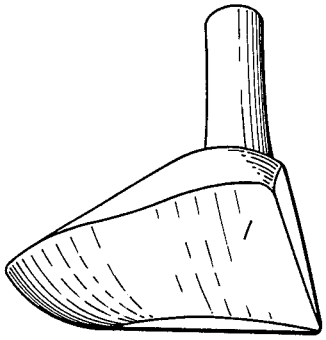
Figure 7B:
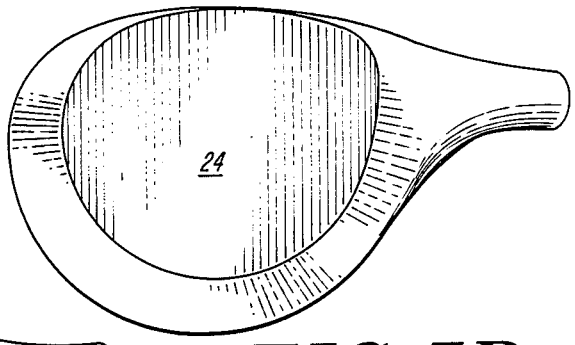
FIGS. 7A–7L are bottom views of the clubs of FIGS. 5A–5L.
Figure 7A:
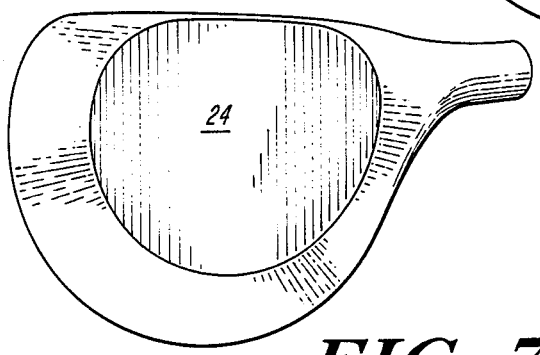
Figure 6C:
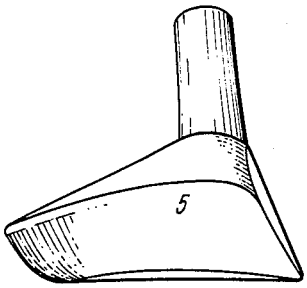
Figure 6D:
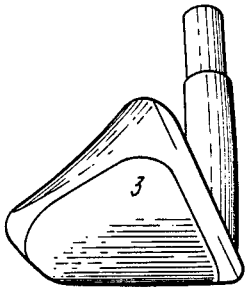
Figure 7C:
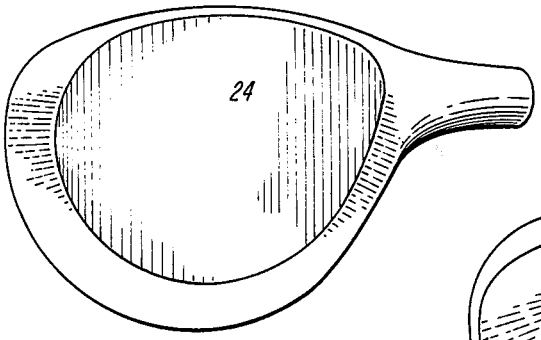
Figure 7D:
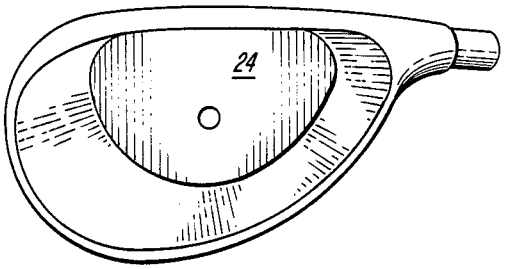
Figure 6E:
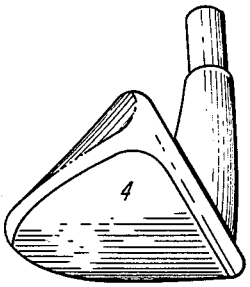
Figure 6F:
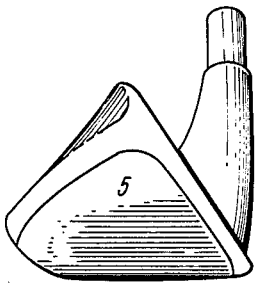
Figure 7E:
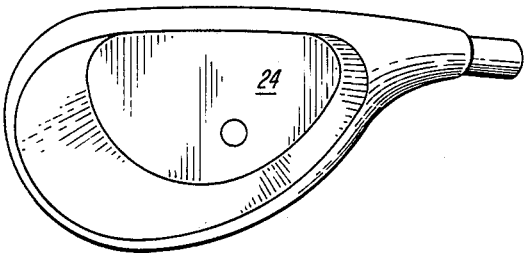
Figure 7F:
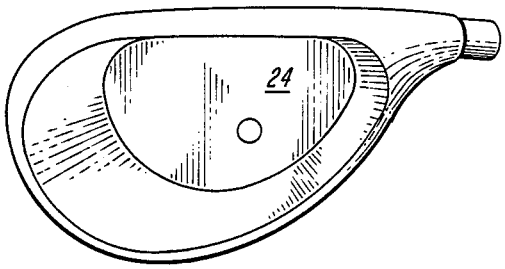

FIGS. 3 and 4 illustrate another type of construction useful for making clubs embodying the invention. The 7 iron 20 comprises a head 22 defining a face 14 and a sole 24. The head 22 is formed of polyurethane molded by the well known reaction injection molding (RIM) technique which encapsulates a high density, typically metal insert 26 which is shaped and located to place the center of gravity c.g. of the club head close to the sole 24 and disposed rearwardly from the face 14, and essentially half way between the toe 28 and heel 30. A portion of the encapsulated insert weight 26 forms a hosel 32 which receives a shaft (not shown).

Figure 2:
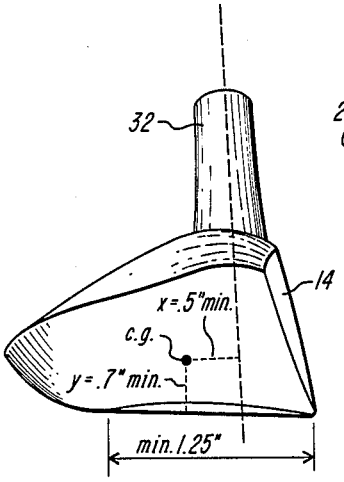
FIG. 2 is a schematic, toe-on view of the club head of a driver embodying the invention.

The construction approaches illustrated in FIGS. 1, 3 and 4, permit weight to be removed from the hosel area about the heel 30 and to be disposed closer to the toe 28. This has the effect of moving the center of gravity c.g. of the club head closer to the toe 28 and more in line with the midpoint of the club face between the toe and head. Also, the center of gravity is lowered toward the sole 24 and moved rearwardly into the body 22 of the club head 20 back from the club face 14. Preferably, as illustrated in FIG. 2, the center of gravity c.g. of the club head is at least 0.50 inch from the centerline of the shaft of hosel 32 (dimension X), and is no more than about 0.70 inch from the sole 24 (dimension Y). The center of gravity c.g. is also substantially at the midpoint of the horizontal dimension (from heel to toe) of the club face 14.

The combination of these club head design characteristics results in weight removal from those areas of the club head where weight is not helpful, namely the hosel area, the crown, and the heel, while allowing weight to be added in the critical areas where it is needed, such as behind the hitting surface close to the sole, thereby creating a lower center of gravity and adding to the energy imparted by the club face to the ball at impact. One result of this low center of gravity is a higher trajectory for balls driven with these clubs.

The shafts used with the club heads of the set are conventional. These sold by True Temper and known as "jet step shafts" are preferred because of their light weight and low flex point.

Figure 5A:
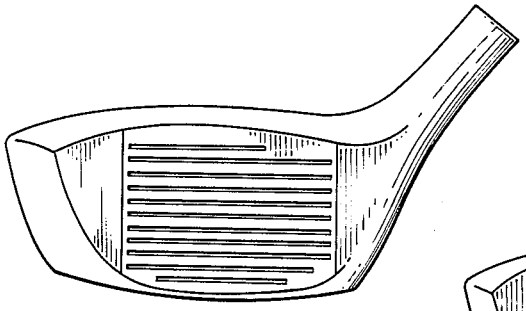
FIGS. 5A–5L are face-on views of the club heads of a set of clubs including 1, 3, and 5 woods, 3, 4, 5, 6, 7, 8 and 9 irons, a pitching wedge, and a sand club.
Figure 5B:
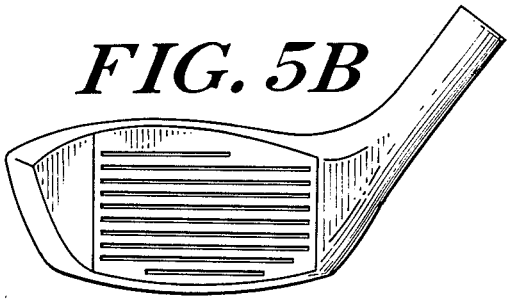
Figure 5C:
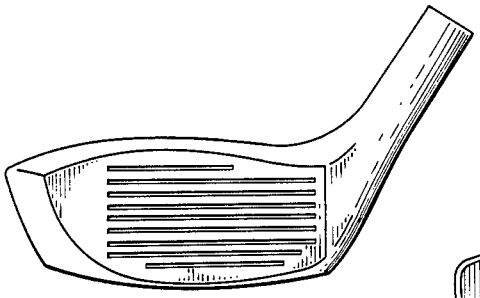
Figure 5D:
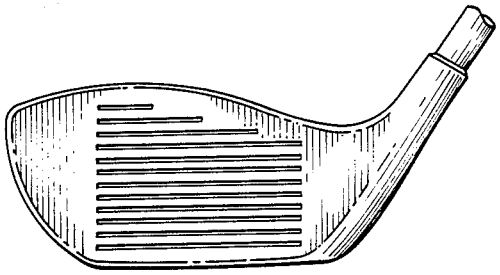
Figure 5E:
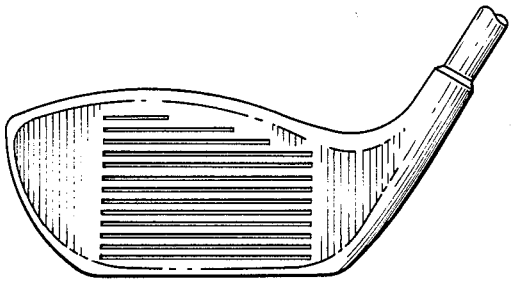
Figure 5F:
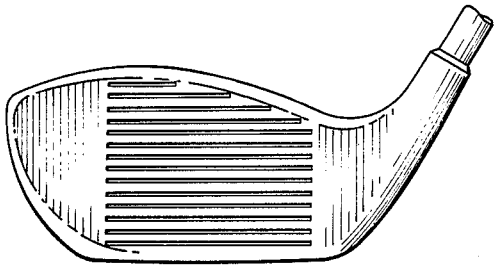
Figure 5G:
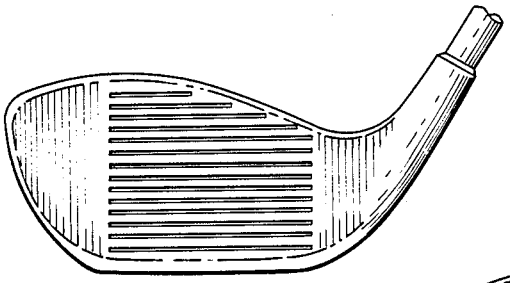
Figure 5H:
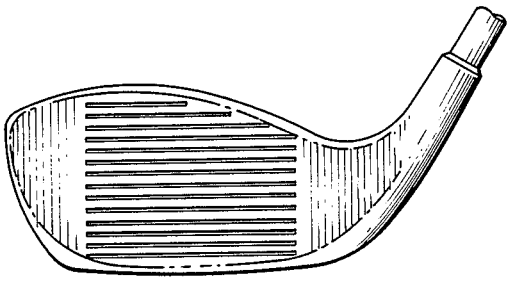
Figure 6G:
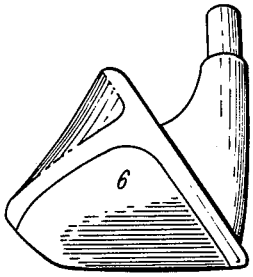
Figure 6H:
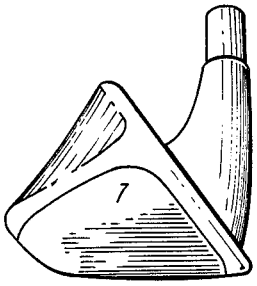
Figure 7G:
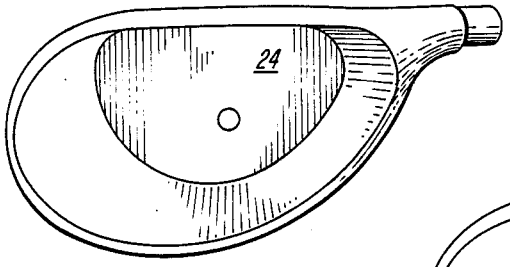
Figure 7H:
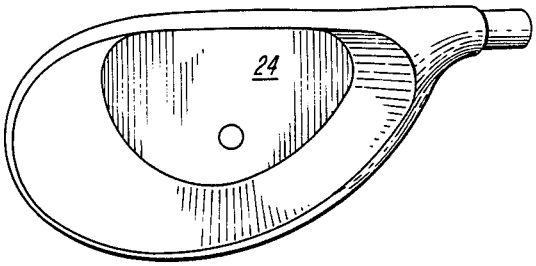
Figure 5I:
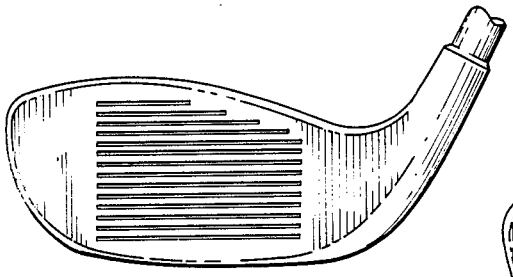
Figure 5J:
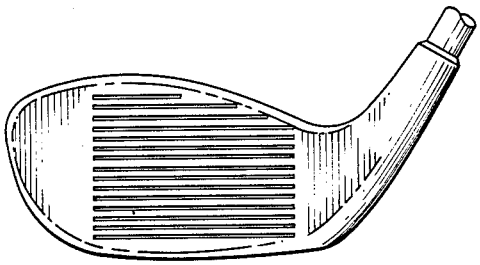
Figure 6I:
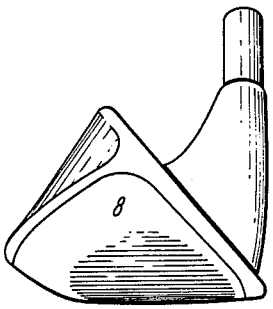
Figure 6J:
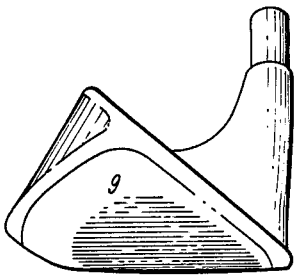
Figure 7I:
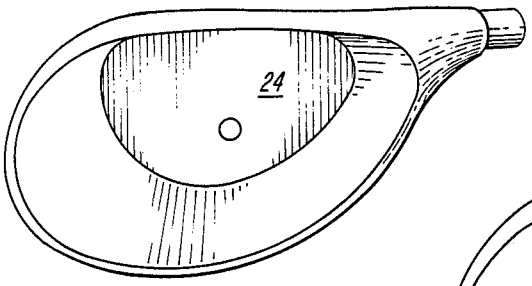
Figure 7J:
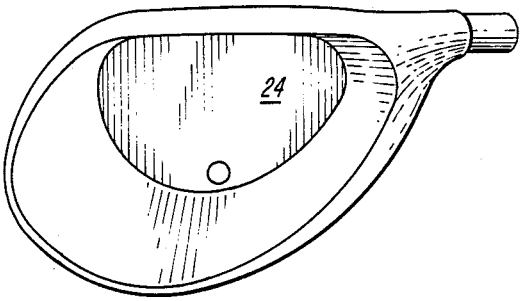
Figure 5K:
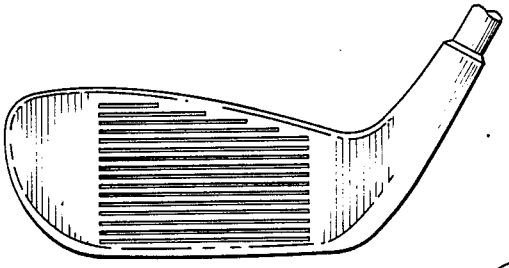
Figure 5L:
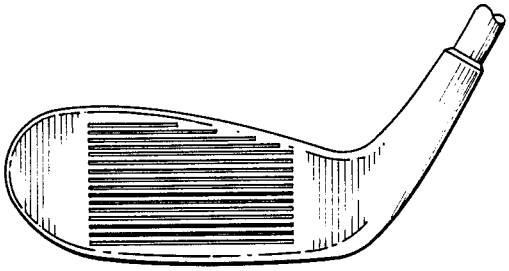
Figure 6K:
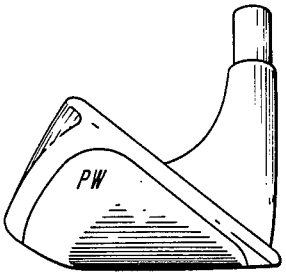
Figure 6L:
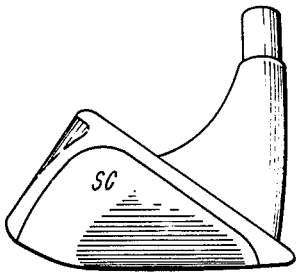
Figure 7K:
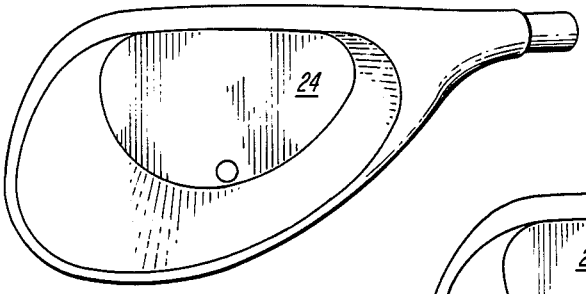
Figure 7L:
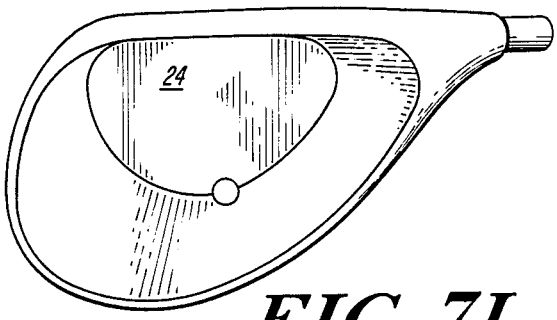

In FIGS. 5H, 6H, and 7H, there is illustrated a 7 iron constructed in accordance with the principles of this invention. This No. 7 iron is formed of a hollow metal construction as shown in FIG. 1 and has the heavier toe discussed above. Note that the body of the club head is much wider from the hitting face to the rear than is usual for irons. The sole width is 1.5625 inch, in comparison to approximately 0.4–1.0 inch, typically about 0.8 inch or less, for conventional iron construction. The center of gravity of the iron is low, e.g., 0.625 inches from the sole as opposed to about 0.8 inches in a more conventional iron construction. The center of gravity is also moved to the rear so that in the 7 iron club illustrated it is about 0.37 inches from the face as opposed to 0.145 inches in more conventional clubs. The other irons are of similar construction with the values in loft and lie increasing from club to club from the No. 3 iron up to the No. 9 iron, as well as to the pitching wedge and sand club.

Figure 8:
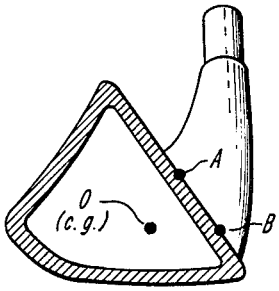
FIG. 8 is a toe-on sectional view of a 7 iron club head embodying the present invention.

Given that the head velocity of an iron is constant, all of the components of the head have the same translational or forward velocity at impact. When this velocity acts at an angle from the forward or horizontal with respect to the center of gravity, the velocity imparted to the ball will vary as the cosine of the angle AOB. Referring to FIG. 8, A is the center of the club face, c.g. is the center of gravity, and B is the point of impact. The further back the center of gravity is from the impact point, the more the moment of inertia of the head will increase, the more the head will be resistant to twisting, and the more energy will be imparted to the golf ball.

Thus in a 7 iron described above, if the point of impact is 0.3114 inches above the ground line, the impact angle AOB is 27° with a resultant efficiency of head velocity of 89%. For a conventional club having a center of gravity 0.8125" above the sole, a ball hitting the same impact point, that is, a point 0.3114" above the sole, would have an impact angle AOB of 43° and an efficiency of head velocity of only 73%. Similarly, if the impact point is ½" above the sole, for the club of this invention as described above, the impact angle would be 16° and the efficiency of head velocity would be 96%. For the same circumstances with a conventional club head the impact angle would be 38° and the efficiency of head velocity would be only 79%. Thus, for hits off line with the center of gravity, the effective club head velocity and accordingly the ball velocity will be higher for clubs constructed as described above with a low center of gravity, than they will be for conventional club head construction.

These construction approaches enable the implementation of a club set design approach which achieves a set of clubs from driver through 9 iron, pitching wedge, and sand club that are more similar in appearance, design, and playing characteristics than conventional club sets. Furthermore, each club in the set is easier to hit, propels the ball on a higher trajectory, and hits balls straighter than conventional clubs.

A significant advantage of molding all of the clubs from the driver to the 9 iron and beyond from RIM polyurethane or employing the two piece hollow metal construction is that the construction of a continuous set of clubs which does not have the discontinuity in structure typical of conventional woods and irons is possible. This, in turn, allows for a more integrated play of all of the clubs. The characteristics of shaft length, lie, loft, and leading edge progression as illustrated in TABLE I, provide for a continuity of incremental changes, rather than the overlap illustrated in the prior art.

The preferred club set embodying the invention is shown in FIGS. 5A–5L, 6A–6L, and 7A–7L, which illustrate the 1, 3, and 5 woods, the 3, 4, 5, 6, 7, 8, and 9 irons, and an optional pitching wedge and sand club, from a face-on view, toe-on view, and bottom view, respectively. An inspection of these drawn figures, and the specifications for the clubs set forth in Table I, will make apparent certain aspects of the invention. These including the continuity of change in face progression, loft angle, club length, and lie from club to club, the extremely wide sole of the irons, and the striking similarity of appearance of the woods and irons. Other novel features of preferred club sets embodying the invention include the inclusion of a male hosel in the preferred hollow metal irons, and the design of a face radius in the irons.

TABLE I

SPECIFICATIONS FOR CLUBS SHOWN IN FIGS. 5A THROUGH 5L

| | D | #3W | #5W | #3 | #4 | #5 | #6 | #7 | #8 | #9 | PW | SC |
|---|---|---|---|---|---|---|---|---|---|---|---|---|
| LIE ANGLE | 55° | 55½° | 56° | 58° | 59° | 60° | 60½° | 61° | 61½° | 62° | 63° | 63° |
| LOFT | 12° | 17° | 21° | 24° | 28° | 31° | 34° | 38° | 41° | 45° | 51° | 57° |
| CLUB LENGTH | 43¼" | 42" | 40¾" | 39½" | 38½" | 37½" | 37" | 36½" | 36" | 35½" | 35" | 35" |
| FACE PROGRES. | +.510 | +.450 | +.395 | +.122 | +.106 | +.093 | +.089 | +.069 | +.062 | +.038 | .014 | −.013 |
| LEADING EDGE PROGRESSION | +.613 | +.625 | +.628 | +.205 | +.205 | +.205 | +.215 | +.215 | +.225 | +.225 | +.245 | +.275 |
| VISUAL OFFSET | | | | −.020 | −.020 | −.020 | −.010 | −.010 | 0 | 0 | +.020 | +.050 |
| SOLE RADIUS | 5" | 5" | 5" | 8 × 9" | 8 × 9" | 8 × 9" | 8 × 9" | 8 × 9" | 8 × 9" | 8 × 9" | 8 × 9" | 8 × 6" |
| SLICE ANGLE | 1½° | 2° | 2½° | — | — | — | — | — | — | — | — | — |
| HEAD LENGTH | 3.730" | 3.402" | 3.383" | 3.600" | 3.600" | 3.600" | 3.600" | 3.600" | 3.600" | 3.600" | 3.600" | 3.675" |
| HEAD WIDTH | 2.920" | 2.750" | 2.600" | 2.125" | 2.125" | 2.125" | 2.125" | 2.125" | 2.125" | 2.200" | 2.300" | 2.500" |
| HEAD DEPTH | 1.750" | 1.500" | 1.450" | 1.550" | 1.600" | 1.650" | 1.670" | 1.650" | 1.600" | 1.550" | 1.500" | 1.375" |
| FACE HEIGHT | 1.650 | 1.400 | 1.350 | 1.500 | 1.550 | 1.610 | 1.620 | 1.620 | 1.570 | 1.530 | 1.480 | 1.365 |
| FACE RADIUS | 10 × 15" S | 10 × 15" S | 10 × 15" S | 30" | 30" | 30" | 30" | 30" | 30" | 30" | 30" | 30" |

The irons of the club set embodying the invention, if constructed of metal as illustrated in FIG. 1, also have their weight disposed about the periphery of the club head. This maximizes the club head's moment of inertia tending further to resist rotation on off center hits. The wide sole and massive shape of the iron allow the weight of the head to be spread out to the maximum extent possible, thus benefitting resistance to twisting on off-center hits.

As is apparent from Table I, the irons of the club set of the invention also may have a face radius, e.g., 30 inches. This face radius, in combination with the more rearwardly disposed center of gravity, promotes a gear effect on off center hits toward the toe or heel of the club, which tends to correct the flight of the ball hit off center on the club back toward a line perpendicular to the club face, i.e., toward the center of the field.

FIGS. 5A–5L, 6A–6L, and 7A–7L also show the various features that clubs in the set embodying the invention have in common. Note, for example, the marked similarity of appearance between irons and woods as compared with the prior art. All of the clubs have a crown whose high point is disposed between the toe and heel, generally between about ½ and ¾ of the distance from the shaft to the toe. The sole of the clubs, as shown in FIGS. 6A–6L and 7A–7L, are uniformly wide, with the sole of the woods being about 2.125 inches wide and that of the irons 1.5625 inches wide. The bounce of the irons is very slight. The wide soles on the irons make them extremely easy to hit. The difference between the leading edge progression of the woods and irons is less than in conventional clubs. The irons are further forward than most conventional irons yet retain a slight offset. The face progression of the set of irons is fairly consistant throughout the set and progresses continuously.

While the invention has been described in terms of clubs of hollow metal and clubs molded of RIM polyurethane, other materials may be suitable, provided that they have an intermediate density, on the order of 0.9 to 1.50 g/cc, and that they can be molded with sufficient precision to achieve the proper reproducibility of club shapes and face angles, together with the strength required to produce a durable golf club. Materials such as molded polyester may be suitable.

Having described the invention, various modifications may well occur to those skilled in the art.

What is claimed is:

1. A golf club comprising a head and a shaft, said head being shaped to define a ball striking face, a crown and a sole, said sole being disposed on the bottom of said head, the width of the sole, measured at the widest portion of the sole, being at least 1.25 inches, said sole width being defined as the distance between the front edge of the sole and the rear edge of the sole wherein the front edge of the sole is defined by the intersection of the sole curve of the club and the lower edge of the striking face, and the rear edge of the sole is defined by the intersection of the sole curve and the back curve of the club, said club head having a center of gravity located substantially at the midpoint of the horizontal dimension of the ball striking face of the club, at least 0.5 inch behind a centerline of the shaft extending through the club head, and not more than 0.7 inch above the sole.

2. The club of claim 1 wherein said head defines a face comprising a surface integral with the remaining body of the club head.

3. The club of claim 1 having a loft angle of at least 22°.

4. The club of claim 1 wherein said head comprises metal defining a hollow interior, and a hosel.

* * * * *